US010161289B2

(12) United States Patent
Woo et al.

(10) Patent No.: US 10,161,289 B2
(45) Date of Patent: Dec. 25, 2018

(54) COOLING SYSTEM OF ENGINE

(71) Applicant: Hyundai Motor Company, Seoul (KR)

(72) Inventors: Soo Hyung Woo, Yongin-si (KR); Kwang Sik Yang, Gunpo-si (KR); Jin Woo Cho, Seongnam-si (KR); Seung Kook Han, Seoul (KR); Jin Wook Son, Suwon-si (KR); Wootae Kim, Anyang-si (KR)

(73) Assignee: Hyundai Motor Company, Seoul (KR)

( * ) Notice: Subject to any disclaimer, the term of this patent is extended or adjusted under 35 U.S.C. 154(b) by 5 days.

(21) Appl. No.: 15/261,272

(22) Filed: Sep. 9, 2016

(65) Prior Publication Data

US 2017/0074152 A1 Mar. 16, 2017

(30) Foreign Application Priority Data

Sep. 11, 2015 (KR) ..... 10-2015-0129218

(51) Int. Cl.

| | |
|---|---|
| ***F01P 3/02*** | (2006.01) |
| ***F02F 1/10*** | (2006.01) |
| ***F02F 1/36*** | (2006.01) |
| ***F02F 1/14*** | (2006.01) |
| *F02B 33/00* | (2006.01) |

(52) U.S. Cl.

CPC *F01P 3/02* (2013.01); *F02F 1/10* (2013.01); *F02F 1/14* (2013.01); *F02F 1/36* (2013.01); *F01P 2003/021* (2013.01); *F01P 2003/024* (2013.01); *F02B 33/00* (2013.01)

(58) Field of Classification Search

CPC ..... F01P 3/02; F02F 1/10; F02F 1/36; F02F 1/02

See application file for complete search history.

(56) References Cited

U.S. PATENT DOCUMENTS 5,253,615 A * 10/1993 Heater ..... F02F 1/108 123/195 R
5,937,803 A * 8/1999 Murata ..... F02F 7/007 123/41.74

(Continued)

FOREIGN PATENT DOCUMENTS

JP 2003-222022 A 8/2003
JP 4552884 B2 9/2010

(Continued)

*Primary Examiner* — Long T Tran

(74) *Attorney, Agent, or Firm* — Morgan, Lewis & Bockius LLP

(57) ABSTRACT

A cooling system of an engine may include a cylinder liner formed in a hollow cylindrical shape and pressed against an inside of a cylinder of the engine, a block coolant jacket positioned in an outer side of the cylinder liner in a radial direction to cool a cylinder block, the cylinder block provided with the cylinder liner and the block coolant jacket therein, and a cylinder head engaged on the cylinder block, including an exhaust port and an intake port fluidically-communicated with a combustion chamber and respectively formed at an exhaust side and an intake side, and provided with a head coolant jacket inside, in which the block coolant jacket includes an upper coolant jacket and a lower coolant jacket and a division wall is disposed between the upper coolant jacket and the lower coolant jacket to block fluid flow therebetween.

12 Claims, 3 Drawing Sheets

(56) References Cited

U.S. PATENT DOCUMENTS

| | | | | |
|---|---|---|---|---|
| 6,101,994 | A * | 8/2000 | Ichikawa | F01M 11/02 123/195 R |
| 6,581,550 | B2 * | 6/2003 | Shinpo | F01P 3/02 123/41.74 |
| 6,874,451 | B2 * | 4/2005 | Matsutani | F01P 3/02 123/41.79 |
| 8,096,270 | B2 * | 1/2012 | Yamada | B22D 19/00 123/193.2 |
| 2009/0194046 | A1 * | 8/2009 | Shikida | F02F 1/14 123/41.74 |
| 2014/0283765 | A1 * | 9/2014 | Naito | F01P 3/12 123/41.09 |
| 2015/0345363 | A1 * | 12/2015 | Marutani | F02F 1/166 123/41.44 |

FOREIGN PATENT DOCUMENTS

| | | | |
|---|---|---|---|
| JP | 2015-110919 | A | 6/2015 |
| KR | 10-2001-0005359 | A | 1/2001 |
| KR | 10-2013-0019172 | A | 2/2013 |
| KR | 10-2013-0073497 | A | 7/2013 |
| KR | 10-2014-0128518 | A | 11/2014 |

* cited by examiner

COOLING SYSTEM OF ENGINE

CROSS-REFERENCE TO RELATED APPLICATION

The present application claims priority to Korean Patent Application No. 10-2015-0129218, filed Sep. 11, 2015, the entire contents of which is incorporated herein for all purposes by this reference.

BACKGROUND OF THE INVENTION

Field of the Invention

The present invention relates to a cooling system of an engine dividing vertically a coolant jacket corresponding to a cylinder liner of a cylinder block and controlling a flow of a coolant circulating the coolant jacket to improve an entire cooling efficiency and to reduce an abnormal combustion of a combustion chamber.

Description of Related Art

Engines produce torque by burning a fuel to create energy, and discharge surplus thermal energy. Particularly, a coolant absorbs thermal energy as it circulates through an engine, a heater, and a radiator, and releases the thermal energy.

Oil becomes highly viscous at low engine coolant temperatures. With thick oil, friction and fuel consumption increase, and exhaust gas temperatures rise gradually, lengthening the time taken for catalyst activation and causing deterioration in exhaust gas quality. Moreover, it takes a long time to get a heater to function normally, so passengers and a driver will feel cold at low temperatures.

When the engine coolant temperature is excessively high, knocking may occur. If ignition timing is adjusted to suppress knocking, the engine performance may be degraded. In addition, excessive lubricant temperatures may result in poor lubrication.

However, one coolant control valve is used in specific regions of an engine, and is a valve that controls a number of cooling elements, like keeping the coolant at high temperatures and other regions at low temperatures.

Among the several cooling elements, a cylinder block and a cylinder head are important, and a technique of separately cooling the cylinder block and the cylinder head has been researched.

On the other hand, since the top part of the cylinder block is adjacent to the combustion chamber, the temperature thereof is high, since the bottom part of the cylinder block is far away from combustion chamber, the temperature thereof is low, in this case, because the coolant is controlled by one coolant jacket, it is difficult to respectively control the top part and the bottom part to be optimized.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cooling system of an engine dividing vertically a coolant jacket corresponding to a cylinder liner of a cylinder block to form an upper coolant jacket and a lower coolant jacket and controlling a coolant circulating the upper coolant jacket and the lower coolant jacket, thereby reducing an abnormal combust and decreasing a fuel consumption.

According to various aspects of the present invention, a cooling system of an engine may include a cylinder liner formed in a hollow cylindrical shape and pressed against an inside of a cylinder of the engine, a block coolant jacket positioned in an outer side of the cylinder liner in a radial direction to cool a cylinder block, the cylinder block provided with the cylinder liner and the block coolant jacket therein, and a cylinder head engaged on the cylinder block, including an exhaust port and an intake port fluidly communicated with a combustion chamber and respectively formed at an exhaust side and an intake side, and provided with a head coolant jacket inside, in which the block coolant jacket may include an upper coolant jacket formed in a shape covering an upper portion of the cylinder liner, and a lower coolant jacket formed in a shape covering a lower portion of the cylinder liner and separated from the upper coolant jacket, and a division wall may be disposed between the upper coolant jacket and the lower coolant jacket to block fluid flow therebetween.

The upper coolant jacket may include an exhaust side upper coolant jacket formed at the exhaust side, and an intake side upper coolant jacket formed at the intake side, and a coolant discharged from a coolant pump may sequentially pass through the exhaust side upper coolant jacket, the head coolant jacket, and the intake side upper coolant jacket.

The lower coolant jacket may include an exhaust side lower coolant jacket formed at the exhaust side, and an intake side lower coolant jacket formed at the intake side, and the coolant passing through the exhaust side upper coolant jacket, the head coolant jacket, and the intake side upper coolant jacket may sequentially pass through the intake side lower coolant jacket and the exhaust side lower coolant jacket to execute cooling thereof.

The coolant discharged from the coolant pump may sequentially pass through the exhaust side upper coolant jacket, the head coolant jacket, the intake side upper coolant jacket, the intake side lower coolant jacket, and the exhaust side lower coolant jacket may be circulated to the coolant pump to perform cooling thereof.

The cooling system of the engine may further include a coolant control module disposed in a coolant line connected from the intake side upper coolant jacket to the intake side lower coolant jacket to control flow of the coolant.

The coolant control module may distribute the coolant to at least one of a radiator to radiate a heat of the coolant, an EGR cooler to control temperature of the recirculating exhaust gas, an oil cooler to control an oil temperature of the engine, a transmission oil cooler to control oil temperature of a transmission, and a heater disposed for an indoor heating, and the coolant control module may control distributed coolant.

According to various aspects of the present invention, a cooling system of an engine may include a cylinder liner formed in a hollow cylindrical shape and pressed against an inside of a cylinder of the engine, a block coolant jacket positioned in an outer side of the cylinder liner in a radial direction to cool a cylinder block, the cylinder block provided with the cylinder liner and the block coolant jacket therein, a cylinder head engaged on the cylinder block, including an exhaust port and an intake port communicated with a combustion chamber and respectively formed at an exhaust side and an intake side, and provided with a head coolant jacket inside, in which the block coolant jacket includes, an exhaust side upper coolant jacket formed at the exhaust side, an exhaust side lower coolant jacket formed under the exhaust side upper coolant jacket, an intake side upper coolant jacket formed at the intake side, and an intake side lower coolant jacket formed under the intake side upper coolant jacket, and the coolant may execute the cooling while sequentially passing through the exhaust side upper coolant jacket, the head coolant jacket, the intake side upper coolant jacket, the intake side lower coolant jacket, and the exhaust side lower coolant jacket.

A coolant pump may pump the coolant to the exhaust side upper coolant jacket.

The cooling system of the engine may further include a coolant control module to control a flow of the coolant exhausted from the intake side upper coolant jacket.

The cooling system of the engine may further include a branch line branched from a coolant line formed between the intake side upper coolant jacket and the coolant control module and connected to the intake side lower coolant jacket.

The branch line may include a control valve disposed to control the flow of the coolant.

A division wall may be formed between the exhaust side upper coolant jacket and the exhaust side lower coolant jacket, and between the intake side upper coolant jacket and the intake side lower coolant jacket.

The block coolant jacket may be formed along an outer surface of the cylinder liner.

According to various embodiments of the present invention, the coolant jacket corresponding to the cylinder liner of the cylinder block is divided into the upper coolant jacket and the lower coolant jacket to respectively control the coolant supplied thereto, thereby further effectively controlling the cooling temperature.

Furthermore, as the coolant sequentially flows the exhaust side upper coolant jacket, the head coolant jacket, the intake side upper coolant jacket, the intake side lower coolant jacket, and the exhaust side lower coolant jacket, the upper side temperature of the cylinder block is controlled to be relatively low and the lower side temperature is controlled to be relatively high such that the fuel consumption may be reduced and the cooling efficiency may be improved, and the abnormal ignition due to the overheating of the combustion chamber may be previously prevented.

Also, by the structure that the coolant is transmitted to the coolant pump through the lower coolant jacket, the cooling passage may be removed or shortened, thereby simply configuring the layout thereof.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
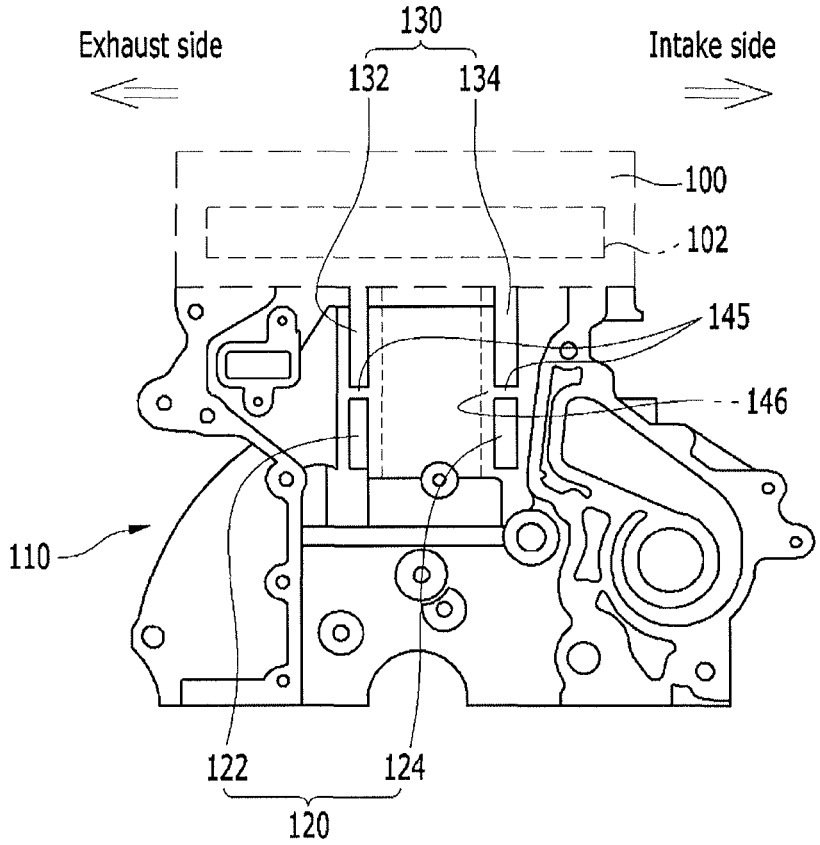
FIG. 1 is a schematic side view of a cylinder block and a cylinder head in a cooling system of an engine according to various embodiments of the present invention.

FIG. 1 is a schematic side view of a cylinder block and a cylinder head in a cooling system of an engine according to various embodiments of the present invention.

Referring to FIG. 1, the cooling system of the engine includes a cylinder block 110 and a cylinder head 100 disposed on the cylinder block 110, and the cylinder block 110 is formed with a cylinder liner 146 disposed to be inserted by a piston. Here, the cylinder liner 146 may be integrally or monolithically formed with the cylinder block 110, or in other embodiments, may be separately installed.

A block coolant jacket is formed outside the cylinder liner 146 in the cylinder block 110. Here, the block coolant jacket includes an upper coolant jacket 130 and a lower coolant jacket 120, and the upper coolant jacket 130 and the lower coolant jacket 120 are divided vertically by a division wall 145.

The upper coolant jacket 130 includes an exhaust side upper coolant jacket 132 formed at an exhaust side and an intake side upper coolant jacket 134 formed at an intake side. The lower coolant jacket 120 includes an exhaust side lower coolant jacket 122 formed at the exhaust side and an intake side lower coolant jacket 124 formed at the intake side.

Furthermore, the head coolant jacket 102 is formed inside the cylinder head 100, the head coolant jacket 102 and the exhaust side upper coolant jacket 132 may be connected and the head coolant jacket 102 and the intake side upper coolant jacket 134 may be connected.

Figure 2:
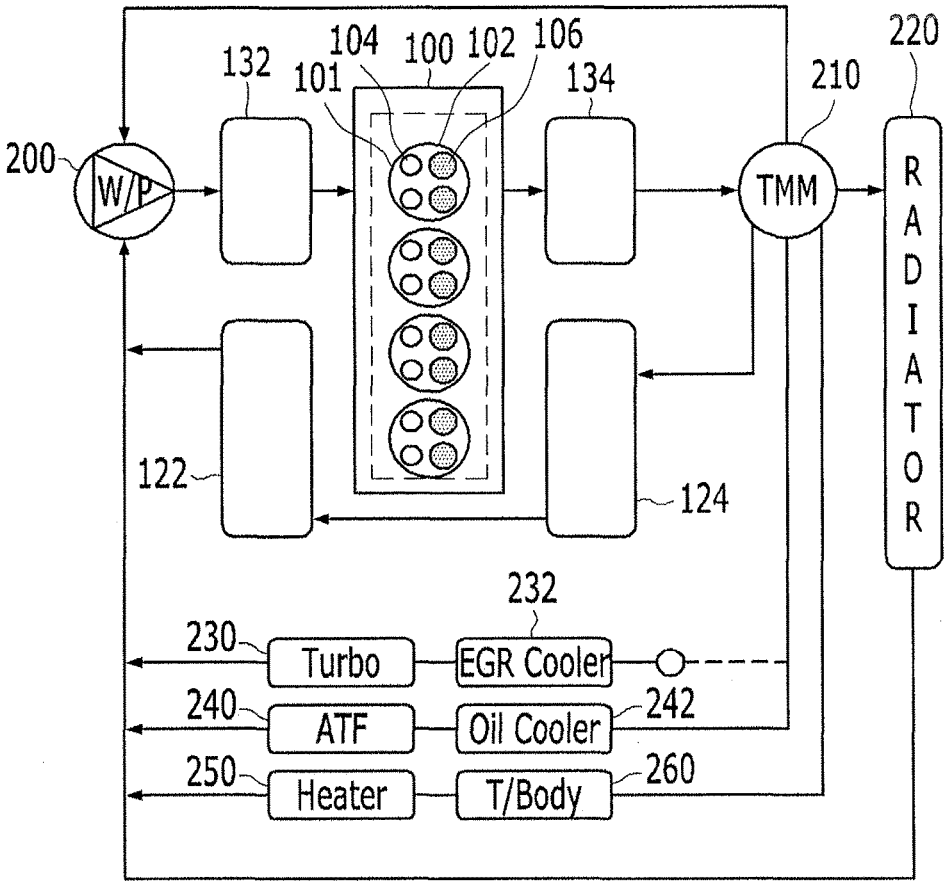
FIG. 2 is an entire schematic diagram showing a flow of a coolant in a cooling system of an engine according to various embodiments of the present invention.

FIG. 2 is an entire schematic diagram showing a flow of a coolant in a cooling system of an engine according to various embodiments of the present invention.

Referring to FIG. 2, the cooling system of the engine includes the coolant pump 200, the exhaust side upper coolant jacket 132, the cylinder head 100, the intake side upper coolant jacket 134, the coolant control module 210, the intake side lower coolant jacket 124, the exhaust side lower coolant jacket 122, the radiator 220, the EGR cooler 232, the turbocharger 230, the oil cooler 242, an Automatic Transmission Fluid (ATF) cooler 240, a throttle body 260, and a heater 250.

Also, an exhaust port 104 and an intake port 106 are formed corresponding to each cylinder 101 in the cylinder head 100, the head coolant jacket 102 is formed around the exhaust port and the intake port therein, and the division wall 145 is formed between the upper coolant jacket 130 and the lower coolant jacket 120.

In various embodiments of the present invention, the division wall 145 may be integrally or monolithically formed with the cylinder block 110, or in other embodiments, may be installed as a separated insert element. Furthermore, as these elements are generally known in the art, a detailed description for the turbocharger 230, the EGR cooler 232, the ATF cooler 240, the oil cooler 242, the heater 250, and the throttle body 260 will be omitted in this specification.

As described above referring to the FIG. 1, the block coolant jacket is positioned in an outer side of the cylinder liner 146 in a radial direction, the block coolant jacket is separated into the upper coolant jacket 130 and the lower coolant jacket 120 by the division wall 145.

From this configuration, as shown in FIG. 2, the coolant pumped by the coolant pump 200 sequentially flows through the exhaust side upper coolant jacket 132, the head coolant jacket 102 which is formed inside of the cylinder head 100, the intake side upper coolant jacket 134, and the coolant control module 210. Also, depending on a control mode of the coolant control module 210, the coolant may be circulated to the coolant pump 200 after sequentially passing through the intake side lower coolant jacket 124 and the exhaust side lower coolant jacket 122. Accordingly, the coolant discharged from the coolant pump 200 is relatively low temperature, and may be supplied into the upper coolant jacket 130, and the coolant passed through the cylinder head 100 is relatively high temperature, and may be supplied into the lower coolant jacket 120.

Therefore knocking of the engine is decreased since an upper portion of the cylinder liner 146 is cooled at low heat. And it can be possible to cut fuel consumption and reduce friction by increasing the temperature of the lower portion of the cylinder block 110.

The coolant control module 210 respectively controls the coolant that is distributed to the intake side lower coolant jacket 124, the oil cooler 242, the throttle body 260, and the radiator 220. Furthermore, the coolant control module 210 may bypass the coolant supplied from the intake side upper coolant jacket 134 to the coolant pump 200 without distribution into each cooling element.

Furthermore, the structure of the coolant control module 210 is generally known in the art and a detailed description of the structure thereof is omitted.

Figure 3:
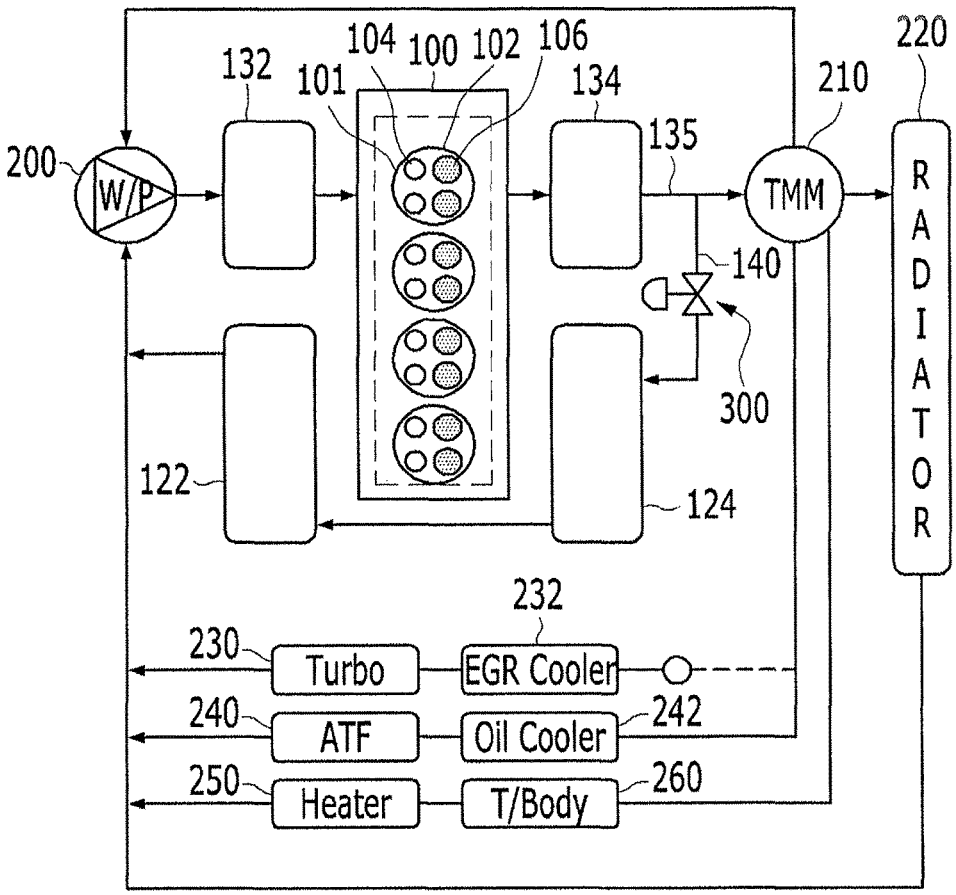
FIG. 3 is an entire schematic diagram showing a flow of a coolant in a cooling system of an engine according to various embodiments of the present invention.

FIG. 3 is an entire schematic diagram showing a flow of a coolant in a cooling system of an engine according to various embodiments of the present invention, and FIG. 3 will be mainly described with respect to characteristic parts compared with FIG. 2.

Referring to FIG. 3, the cooling system of the engine includes the coolant pump 200, the exhaust side upper coolant jacket 132, the cylinder head 100, the intake side upper coolant jacket 134, the control valve 300, the coolant control module 210, the intake side lower coolant jacket 124, the exhaust side lower coolant jacket 122, the radiator 220, EGR cooler 232, the turbocharger 230, the oil cooler 242, the ATF cooler 240, the throttle body 260, and the heater 250.

Also, an exhaust port 104 and an intake port 106 are formed corresponding to each cylinder 101 in the cylinder head 100, the head coolant jacket 102 is formed around the exhaust port 104 and the intake port 106 therein, and the division wall 145 is formed between the upper coolant jacket 130 and the lower coolant jacket 120.

The coolant pumped by the coolant pump 200 sequentially flows through the exhaust side upper coolant jacket 132, the head coolant jacket 102, the intake side upper coolant jacket 134, and the coolant control module 210.

Also, a branch line 140 is branched from the coolant line 135 between the intake side upper coolant jacket 134 and the coolant control module 210, the branch line 140 is connected to the intake side lower coolant jacket 124, and the control valve 300 is provided in the branch line 140.

Depending on the opening/closing of the control valve 300, the coolant of the intake side upper coolant jacket 134 is circulated to the coolant pump 200 after passing through the intake side lower coolant jacket 124 and the exhaust side lower coolant jacket 122 through the control valve 300 of the branch line 140.

In various embodiments of the present invention, the block coolant jacket formed around the cylinder liner 146 of the cylinder block 110 is divided into the upper coolant jacket 130 and the lower coolant jacket 120, and the coolant supplied thereto is respectively controlled, thereby further effectively controlling the cooling temperature.

Furthermore, as the coolant sequentially flows to the exhaust side upper coolant jacket 132, the head coolant jacket 102, the intake side upper coolant jacket 134, the intake side lower coolant jacket 124, and the exhaust side lower coolant jacket 122, the temperature of the upper part of the cylinder block 110 is controlled to be relatively low, and the temperature of the lower part thereof is controlled to be relatively high, thereby reducing the fuel consumption and improving the cooling efficiency.

Also, by the structure that the coolant is transmitted to the coolant pump 200 through the lower coolant jacket 120, the cooling passage may be removed or shortened, thereby simply configuring the layout thereof.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cooling system of an engine comprising:

a cylinder liner formed in a hollow cylindrical shape and pressed against an inside of a cylinder of the engine;

a block coolant jacket positioned in an outside of the cylinder liner in a radial direction to cool a cylinder block;

the cylinder block provided with the cylinder liner and the block coolant jacket therein; and a cylinder head engaged on the cylinder block, including an exhaust port and an intake port fluidically-communicated with a combustion chamber and respectively formed at an exhaust side and an intake side of the cylinder head, and provided with a head coolant jacket inside of the cylinder head, wherein the block coolant jacket includes:

an upper coolant jacket formed in a shape covering an upper portion of the cylinder liner; and a lower coolant jacket formed in a shape covering a lower portion of the cylinder liner and separated from the upper coolant jacket, and wherein a division wall is disposed between the upper coolant jacket and the lower coolant jacket and prevents coolant from directly communicating between the upper coolant jacket and the lower coolant jacket in the cylinder block throughout an entire body of the division wall.

2. The cooling system of the engine of claim 1, wherein the upper coolant jacket includes:

an exhaust side upper coolant jacket formed at the exhaust side; and an intake side upper coolant jacket formed at the intake side, and wherein a coolant discharged from a coolant pump sequentially passes through the exhaust side upper coolant jacket, the head coolant jacket, and the intake side upper coolant jacket.

3. The cooling system of the engine of claim 2, wherein the lower coolant jacket includes:

an exhaust side lower coolant jacket formed at the exhaust side; and an intake side lower coolant jacket formed at the intake side, and wherein the coolant passing through the exhaust side upper coolant jacket, the head coolant jacket, and the intake side upper coolant jacket sequentially passes through the intake side lower coolant jacket and the exhaust side lower coolant jacket to execute cooling thereof.

4. The cooling system of the engine of claim 3, wherein the coolant discharged from the coolant pump sequentially passes through the exhaust side upper coolant jacket, the head coolant jacket, the intake side upper coolant jacket, the intake side lower coolant jacket, and the exhaust side lower coolant jacket is circulated to the coolant pump to perform cooling thereof.

5. The cooling system of the engine of claim 2, further comprising a coolant control module disposed in a coolant line connected from the intake side upper coolant jacket to the intake side lower coolant jacket to control flow of the coolant.

6. The cooling system of the engine of claim 5, wherein the coolant control module distributes the coolant to at least one of:

a radiator to radiate a heat of the coolant;

an EGR cooler to control temperature of recirculating exhaust gas;

an oil cooler to control an oil temperature of the engine;

a transmission oil cooler to control oil temperature of a transmission; and a heater disposed for an indoor heating, and the coolant control module controlling distributed coolant.

7. A cooling system of an engine comprising:

a cylinder liner formed in a hollow cylindrical shape and pressed against an inside of a cylinder of the engine;

a block coolant jacket positioned in an outer side of the cylinder liner in a radial direction to cool a cylinder block;

the cylinder block provided with the cylinder liner and the block coolant jacket therein; and a cylinder head engaged on the cylinder block, including an exhaust port and an intake port fluidically-communicated with a combustion chamber and respectively formed at an exhaust side and an intake side of the cylinder block, and provided with a head coolant jacket inside the cylinder block, wherein the block coolant jacket includes:

an exhaust side upper coolant jacket formed at the exhaust side;

an exhaust side lower coolant jacket formed under the exhaust side upper coolant jacket;

an intake side upper coolant jacket formed at the intake side; and an intake side lower coolant jacket formed under the intake side upper coolant jacket, and wherein the coolant executes the cooling while sequentially passing through the exhaust side upper coolant jacket, the head coolant jacket, the intake side upper coolant jacket, the intake side lower coolant jacket, and the exhaust side lower coolant jacket, and wherein a division wall is formed between the exhaust side upper coolant jacket and the exhaust side lower coolant jacket, and between the intake side upper coolant jacket and the intake side lower coolant jacket, and prevents coolant from directly communicating between the exhaust side upper coolant jacket and the exhaust side lower coolant jacket and between the intake side upper coolant jacket and the intake side lower coolant jacket throughout an entire body of the division wall.

8. The cooling system of the engine of claim 7, wherein a coolant pump pumps the coolant to the exhaust side upper coolant jacket.

9. The cooling system of the engine of claim 7, further comprising a coolant control module to control a flow of the coolant exhausted from the intake side upper coolant jacket.

10. The cooling system of the engine of claim 9, further comprising a branch line branched from a coolant line formed between the intake side upper coolant jacket and the coolant control module and connected to the intake side lower coolant jacket.

11. The cooling system of the engine of claim 10, wherein the branch line includes a control valve disposed to control the flow of the coolant.

12. The cooling system of the engine of claim 7, wherein the block coolant jacket is formed along an outer surface of the cylinder liner.

* * * * *